US006061837A

United States Patent [19]

Oh

[11] Patent Number: 6,061,837

[45] Date of Patent: May 16, 2000

[54] CAP USABLE FOR BASEBALL MITT

[76] Inventor: Sung Hoon Oh, 1772-18, DaeMyung-7 Dong, NamGu, Taegu, Rep. of Korea

[21] Appl. No.: 09/115,812

[22] Filed: Jul. 15, 1998

[51] Int. Cl.[7] ..... A42B 1/06

[52] U.S. Cl. ..... 2/209.12; 2/19; 2/195.1

[58] Field of Search ..... 2/19, 209.12, 195.1, 2/209.13, 195.5, 181

[56] References Cited

U.S. PATENT DOCUMENTS

| | | | |
|---|---|---|---|
| 1,958,804 | 5/1934 | Sherwood | 2/181 |
| 5,481,760 | 1/1996 | Wood, Jr. | 2/195.5 |
| 5,611,118 | 3/1997 | Bibbee | 2/195.1 |

*Primary Examiner*—Diana Oleksa

*Attorney, Agent, or Firm*—Jacobson, Price, Holman & Stern PLLC

[57] ABSTRACT

A cap usable as a baseball mitt has a crown and a brim attached to the crown. Glove bands are providing having a strip T to cope with shocks encountered when catching a baseball and are sewed on the surface of the brim to form a reverse V shape. A first end of each glove band is sewn between the brim and crown and a second end of each glove band is fixed on the under side of brim. A plastic reinforcement band is prepared in the inner end side of crown to reinforce mitt part of the crown. In a second embodiment, the second ends of the glove bands are equipped with first adjustable members. The brim is then fashioned with second adjustable members on a bottom side to engage with the said first adjustable members. A plastic reinforcement is band prepared in the inner end side of crown to reinforce mitt part of the crown.

9 Claims, 7 Drawing Sheets

CAP USABLE FOR BASEBALL MITT

BACKGROUND OF THE INVENTION

1. Field of Invention

This invention relates to head covering, and especially a cap having an auxiliary attachment usable for baseball mitt.

2. Description of the Prior Art

Many athletes and sports fans wear various caps. Baseball caps are especially worn as a token of deep enthusiasm for excellent sportsmen. Moreover, in many cases, the fans want to play themselves. However, real baseball gloves are a burden to use for play in a backyard or nearby park and heavy or awkward to carry. This is the reason why many contrivances have been made for the cap to be usable as baseball mitt. There have been devised various structures which provide caps or head coverings usable for baseball mitt. For example, U.S. Pat. Nos. 4,768,232, 4,829,600, 4,628,543 shows various types of caps having a built in glove. These prior art caps have glove typed attachments in the inner side of a cap that operate as baseball mitts. However, these prior art caps have several defects for a real usage such as;

1. The cost for making a glove type pocket in the inner side of a cap is high.

2. In real usage, the user may encounter great aches in his palm and is subject to an injury of hands.

3. The outer appearances are not good or attractive and does not feel smart.

SUMMARY OF THE INVENTION

An object of the present invention is to provide a newly invented cap or head covering usable, for instance, as a baseball mitt and having a simple structure to overcome the prior art's flaws. It is another object of this invention to provide a cap usable as a baseball mitt having good appearances and smart wearing feelings.

A cap usable for baseball mitt according to this invention comprises; A crown and a brim attached and secured to a crown, Glove bands having strip T to cope with the shocks of baseball and sewed on the surface of brim like a reverse V type or similar, with the one ends of glove bands sewed between brim and crown, and the other ends being fixed on the other side of brim, A plastic reinforcement band prepared in the inner end side of crown to reinforce mitt part of the crown.

BRIEF DESCRIPTION OF THE DRAWINGS

The above and other embodiments of the present invention may be more fully understood from the following detailed description taken together with the accompanying drawings, wherein similar referenced numerals refer to similar elements or parts throughout and in which.

DESCRIPTION OF THE PREFERRED EMBODIMENT

Figure 1:
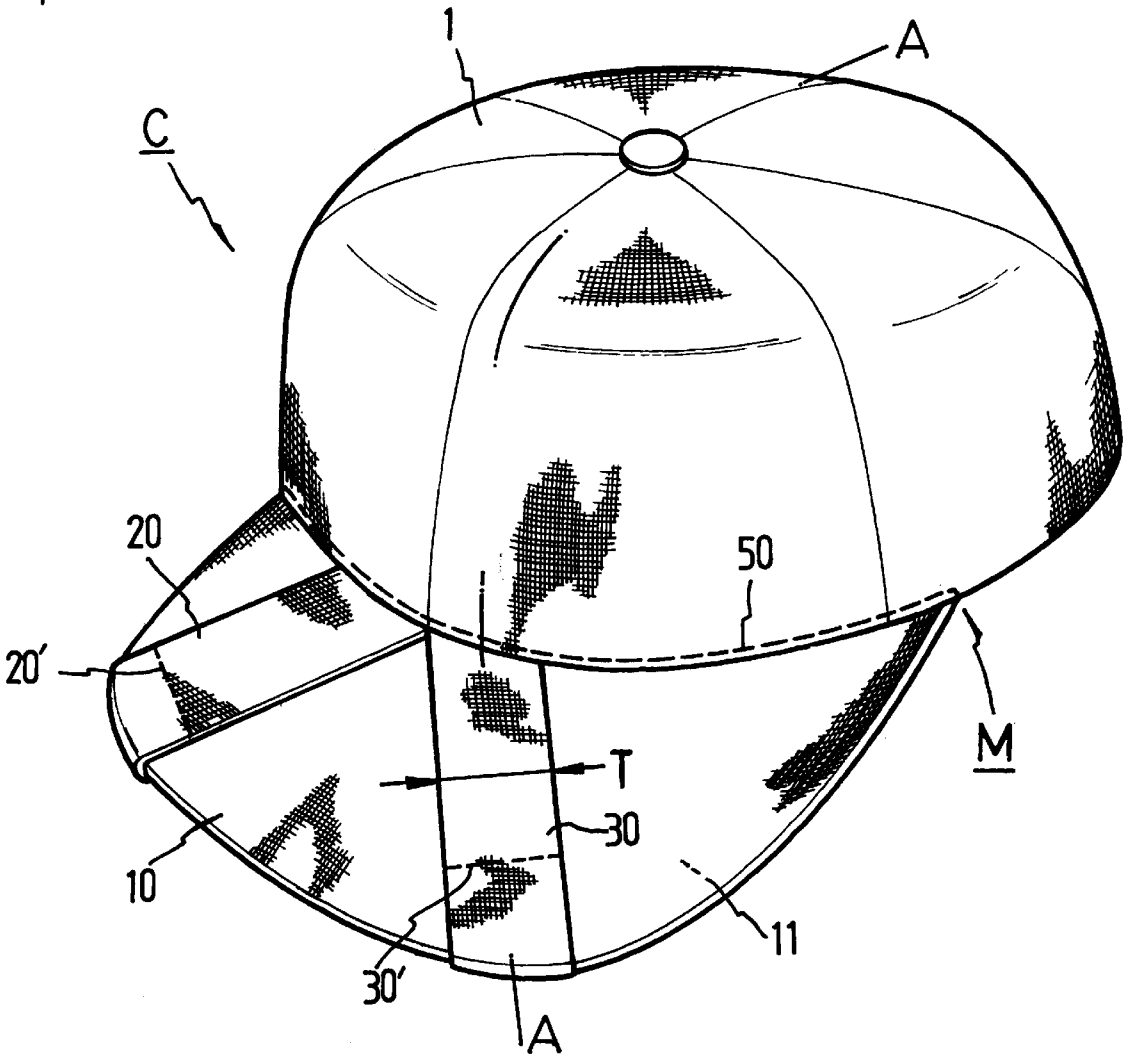
FIG. 1 is a perspective view of a cap of an embodiment of the present invention.
Figure 2:
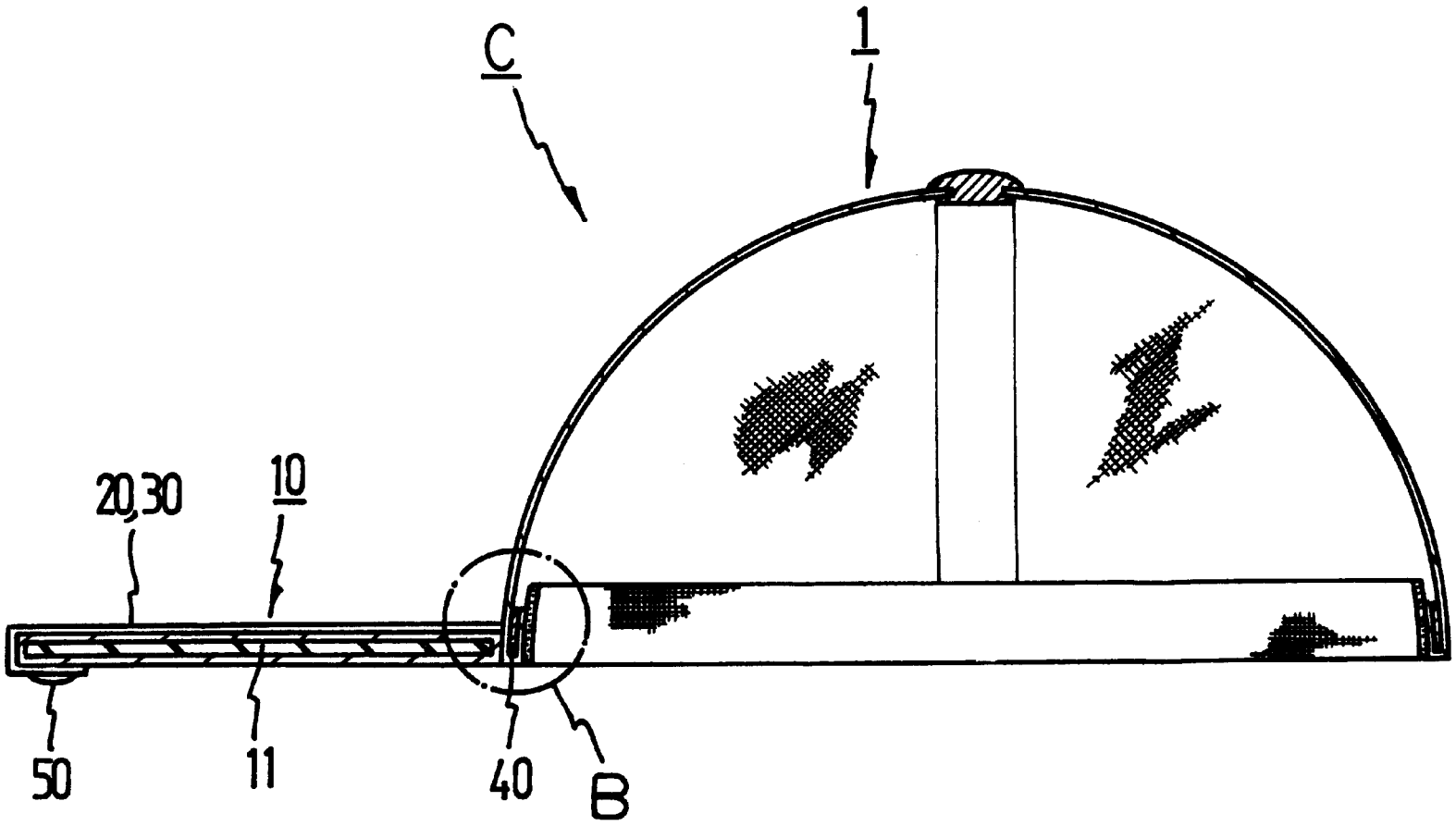
FIG. 2 is a sectional view of A—A of FIG. 1.
Figure 3:
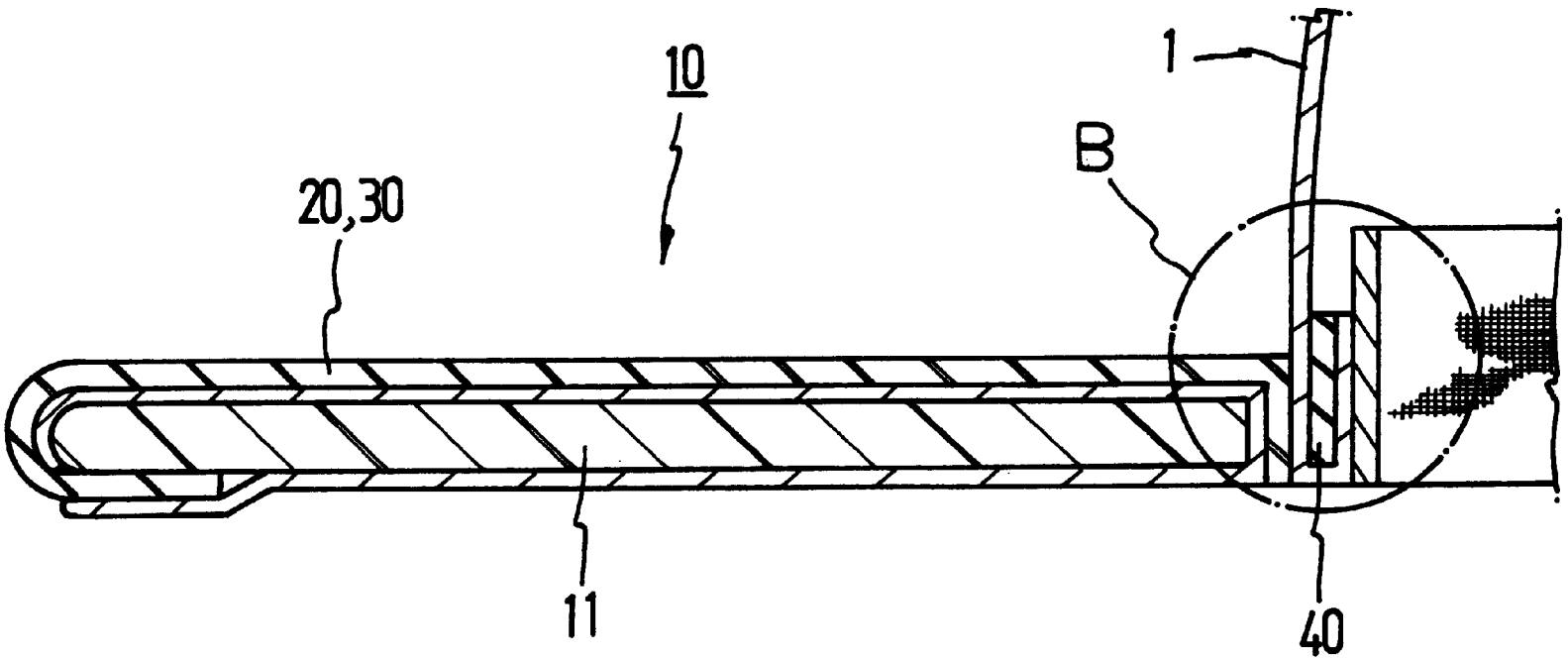
FIG. 3 is a magnified sectional view of A—A of FIG. 1 showing the structure of a cap usable for baseball mitt according to the present invention.
Figure 4:
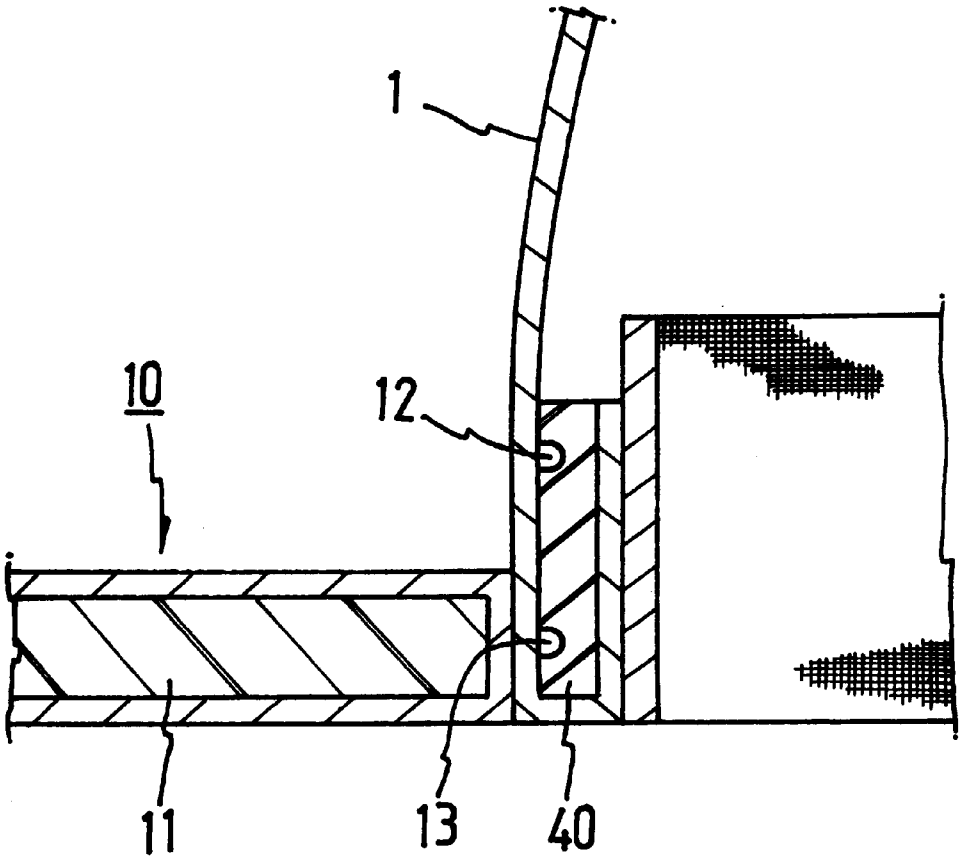
FIG. 4 is a magnified sectional view of part B of FIG. 3 showing the band structure of a cap usable for baseball mitt according to the present invention.
Figure 6:
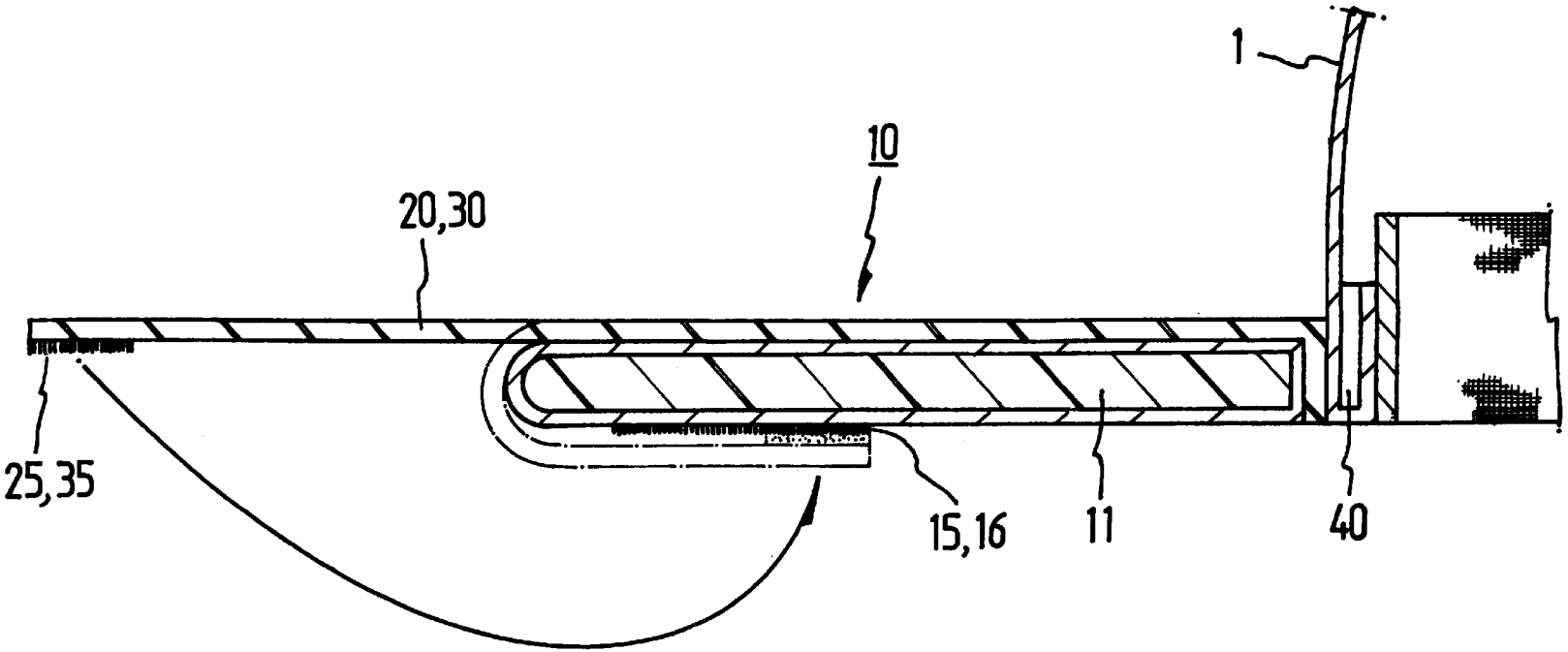
FIG. 6 is a sectional view of C—C of FIG. 5 showing the usage of band according to the present invention.
Figure 7:
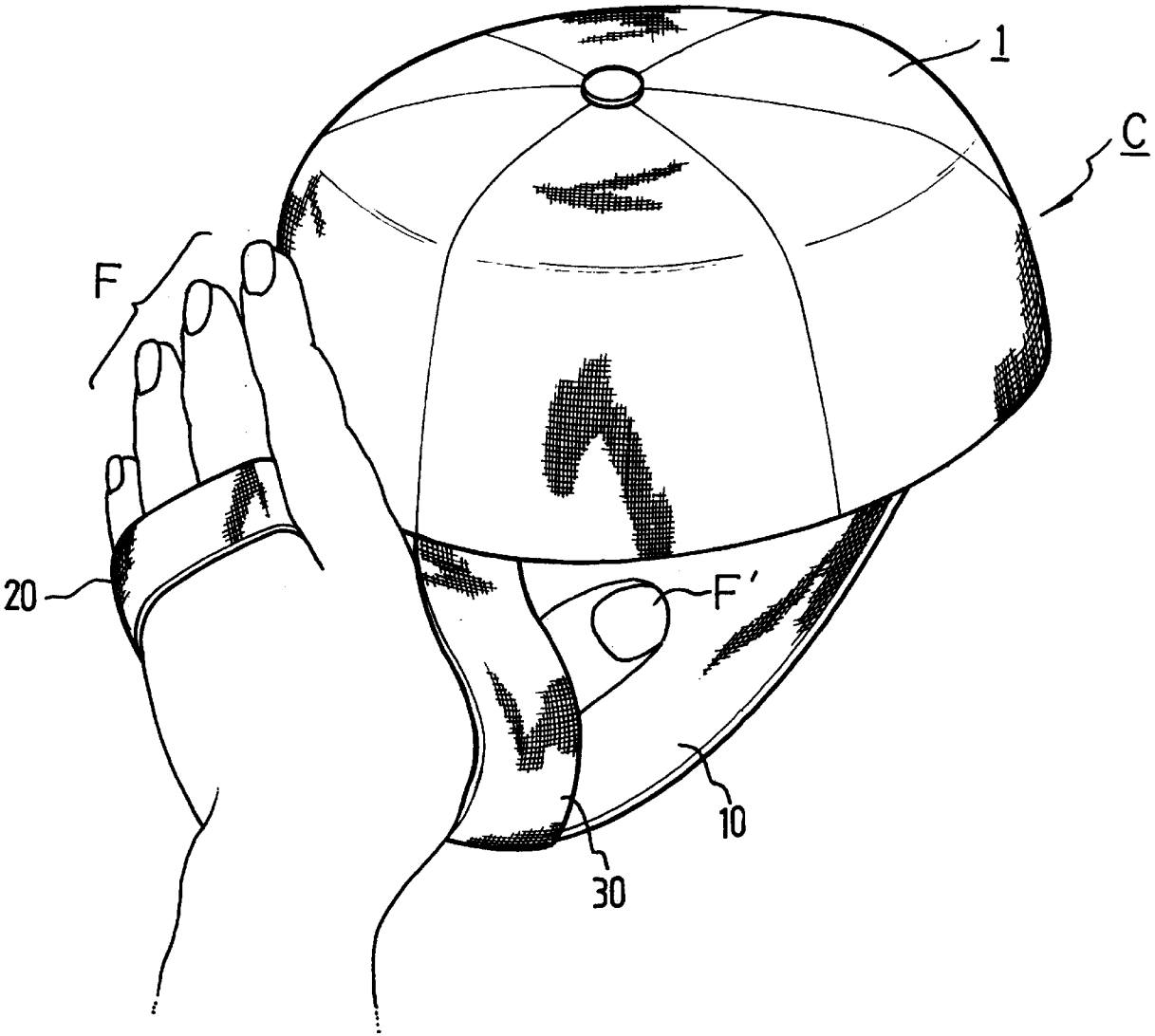
FIG. 7 is a perspective view of using a cap for baseball mitt of the present invention.

Referring now to the drawings, there is illustrated in FIG. 1 a perspective view of a cap according to the present invention and FIG. 6 shows another embodiments of this invention which can have various ways of imposition. Cap C generally comprises a crown 1 and a brim 10 attached and sered to a crown 1 as a usual cap and glove bands 20,30 which comprise a instance baseball mitt. Crown 1 and brim 10 are made of fabric and hardboard materials 11 that are connected by sewing. The thread 50 used in the present invention is preferably three-twisted nylon or the like to reinforce the connection between members to endure sever shocks caused by receiving a baseball. The glove bands 20,30 have adequate strip T to cope with the shocks of baseball and are preferably made of artificial texture such as nylon and/or, polyester. The glove bands 20,30 are laid and sewed on the surface of brim 10 forming a reverse V or similar shape. One end of each glove band 20,30 is laid between crown 1 and brim 10 and sewed together. The other end of each band 20,30 is sewed onto the other side of brim 10 to perform glove bands 20,30 to that are capable of receiving the user's fingers as shown in FIG. 7. A plastic reinforcement band 40 is prepared in the inner end side of the crown to make a perfect form of a cap and to reinforce the crown 1. The reinforcement band 40 is made of plastic by way of extruding and preferably has two channel 12,13 to reinforce by performing an enhanced sectional coefficient and to prevent being twisted when extruded. With the above structure of cap usable for a baseball mitt, the user can use cap C as a baseball mitt as shown in FIG. 7. Fingers F are inserted between the glove bands 20 and brim 10 with thumb F' in glove band 30 and brim 10 are used to curvature brim 10 inward with the inserted fingers F and thumb F' to instantly transform crown 1 into a mitt M to receive baseball. To reinforce and make adequate space for the user, according to the age of user; a stitched line 20', 30' can be added in the appropriate part of glove bands 20,30 along the axial line of glove bands 20,30. With this adjusting stitched line 20', 30', users can choose suitable size of caps according their age or the size of hands.

Figure 5:
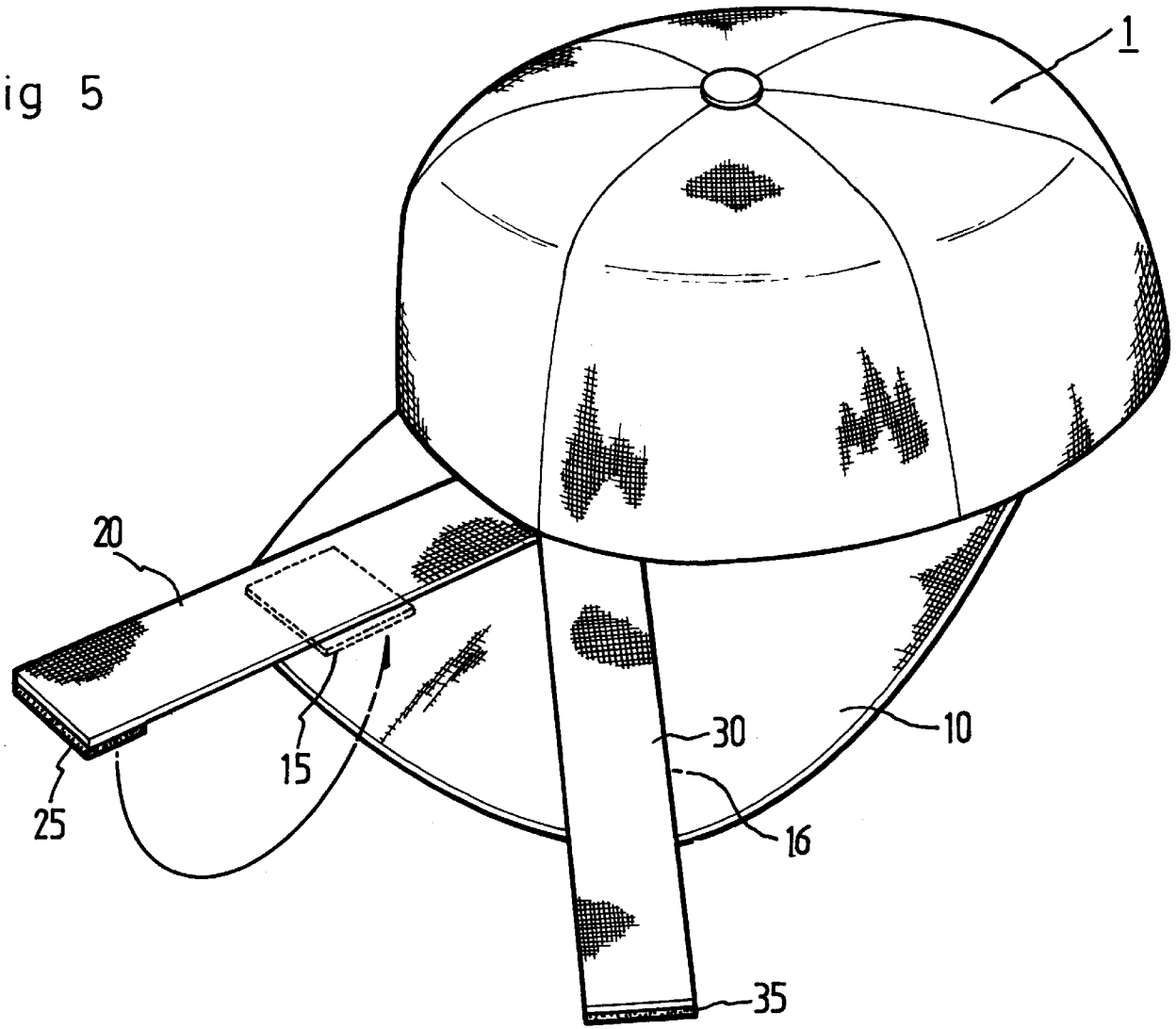
FIG. 5 is a perspective view of another embodiment of a cap usable for baseball mitt according to the present invention.

Another embodiment of a cap usable for baseball mitt according to the present invention is shown in FIGS. 5 and 6 having adjustable glove bands 20,30 for the suitable usage of baseball mitt. In this embodiment, the cap C provides adjustable glove bands 20,30 according to the age or the size of hand of users. The glove bands 20,30 are laid and sewed on the surface of brim 10 like a reverse V type too. One end of each glove band 20,30 is laid between crown 1 and brim 10 and sewed together. The other end of each band 20,30 is elongated compared to the embodiment of FIG. 1 and equipped with the attachable members 25, 35 such as 'so called' a magic tape (Brand name "Velcro"). With the attachable members, 25, 35, the corresponding attachable members 15,16 are stitched on the other side of brim 10 as shown in FIG. 5.

As the attachable members 25,35 chosen as magic tape, members 25,35 can be the male or female hooks face, and the other corresponding attachable members 15,16 are to be female or male hooks face, vice versa.

These members allows users to able to adjust the inserting space between glove bands 20,30 and brim, and select the elastic force of glove bands 20,30 immediately by replacing the coping position of attachable members 25,35 relative to the attachable members 15,16 on the other side of brim 10.

The above concludes descriptions of preferred embodiments of the present invention. Those skilled in the art may find many variations and adaptations falling within the scope of this invention, and the appended claims are intended to cover all such variations and adaptations falling within the true scope and spirit of this invention.

I claim:

1. A cap usable as a baseball mitt, comprising:

a crown having an inner peripheral portion;

a brim secured to said crown, said brim having a top surface and an outer rim;

two glove bands secured to the top surface of said brim to form a general reverse V-shape, a first end of each glove band connected between the brim and crown and a second end of each glove band connected to the outer rim of said brim; and a reinforcement band secured along the inner peripheral portion of said crown to reinforce said crown.

2. The cap of claim 1, wherein said reinforcement band is made of plastic and has two channels extending along a length of said reinforcement band, the two channels reinforcing said reinforcement band.

3. The cap of claim 1, further comprising stitched lines positioned across said glove bands to adjust an opening created by each respective glove band.

4. The cap of claim 1, wherein each glove band forms an opening with said brim to receive at least one finger or thumb of a user.

5. A cap usable as a baseball mitt, comprising:

a crown having an inner peripheral portion;

a brim secured to said crown, said brim having a top surface and an outer rim;

two glove bands secured to the top surface of said brim to form a general reverse V-shape, a first end of each glove band connected between the brim and crown and a second end of each glove band having adjustable members; and a reinforcement band secured along the inner peripheral portion of said crown to reinforce said crown.

6. The cap of claim 5, wherein said adjustable members comprise a first fastening element connected to the second end of each glove band and a second fastening element connected to a bottom surface of said brim for removably engaging said first fastening element.

7. The cap of claim 5, wherein said adjustable members adjust the tension on each of said glove bands.

8. The cap of claim 5, wherein said reinforcement band is made of plastic and has two channels extending along a length of said reinforcement band, the two channels reinforcing said reinforcement band.

9. The cap of claim 5, wherein each glove band forms an opening with said brim to receive at least one finger or thumb of a user.

* * * * *